US006782955B2

(12) United States Patent
Theurer et al.

(10) Patent No.: US 6,782,955 B2
(45) Date of Patent: Aug. 31, 2004

(54) TRACK REHABILITATION MACHINE

(75) Inventors: Josef Theurer, Vienna (AU); Herbert Wörgötter, Gallneukirchen (AU)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 10/292,709

(22) Filed: Nov. 12, 2002

(65) Prior Publication Data

US 2003/0094290 A1 May 22, 2003

(30) Foreign Application Priority Data

Nov. 19, 2001 (AU) ..... 892/2001 U

(51) Int. Cl.[7] ..... E01B 27/10
(52) U.S. Cl. ..... 171/16; 37/104; 104/2
(58) Field of Search ..... 171/16; 37/104, 37/107; 104/2–7.3

(56) References Cited

U.S. PATENT DOCUMENTS 5,394,944 A 3/1995 Theurer et al. ..... 171/16

*Primary Examiner*—Christopher J. Novosad
(74) *Attorney, Agent, or Firm*—Collard & Roe, P.C.

(57) ABSTRACT

A track rehabilitation machine comprises an elongated machine frame supported on the track by undercarriages for movement in an operating direction, the machine frame having two ends. Mounted on the machine frame are a vertically adjustable endless ballast excavating chain for excavating dirty ballast whereon the track is supported, a first conveyor band unit for conveying the excavated dirty ballast from the ballast excavating chain to a ballast transfer station at one machine frame end, a second conveyor band unit for conveying clean ballast from a ballast receiving station at the one machine end to a ballast discharge station arranged rearwardly of the ballast excavating chain, a further ballast transfer station and a further ballast receiving station at the other machine frame end, and further conveyor band units cooperating with the further ballast transfer and receiving stations for respectively conveying ballast to and from a ballast screening car selectively coupled to a respective one of the machine frame ends.

3 Claims, 1 Drawing Sheet

TRACK REHABILITATION MACHINE

BACKGROUND OF THE INVENTION

1. Field of the Invention

The present invention relates to a track rehabilitation machine comprising an elongated machine frame supported on the track by undercarriages for movement in an operating direction, the machine frame having two ends, and mounted on the machine frame a vertically adjustable endless ballast excavating chain for excavating dirty ballast whereon the track is supported, a first conveyor band unit for conveying the excavated dirty ballast from the ballast excavating chain to a ballast transfer station at one machine frame end, and a second conveyor band unit for conveying clean ballast from a ballast receiving station at the one machine end to a ballast discharge station arranged rearwardly of the ballast excavating chain.

2. Description to the Prior Art

Such a machine for cleaning ballast has been disclosed in U.S. Pat. No. 5,394,944. The excavated dirty ballast is conveyed to a ballast screening car coupled to the front end of the machine frame by a first conveyor band unit, and the ballast cleaned on the ballast screening car is conveyed by a second conveyor band unit to a ballast discharge station arranged rearwardly of the ballast excavating chain in the operating direction of the machine. If too little clean ballast is available, a further conveyor band unit at the rear end of the machine frame may convey clean ballast to the ballast discharge station from a storage car. The detritus from the ballast screening car is stored in a storage car coupled to the ballast screening car.

SUMMARY OF THE INVENTION

It is the primary object of this invention to improve such a track rehabilitation machine by enhancing the transport possibilities of the detritus.

The above and other objects are accomplished according to the invention in a track rehabilitation machine of the first-described type by further conveyor band units cooperating with further ballast transfer and receiving stations at the other machine frame end for respectively conveying ballast to and from a ballast screening car selectively coupled a respective one of the machine frame ends.

This makes it possible to change the direction of conveyance of the detritus without problems and without requiring retrofitting for optimal adaptation to logical machine frame conditions. All that is needed is the repositioning of the ballast screening car from one machine frame end to the other.

BRIEF DESCRIPTION OF THE DRAWING

The above and other objects, advantages and features of the present invention will become more apparent from the following detailed description of certain now preferred embodiments thereof, taken in conjunction with the accompanying, somewhat schematic drawing wherein.

DETAILED DESCRIPTION OF THE PREFERRED EMBODIMENTS

Figure 1:
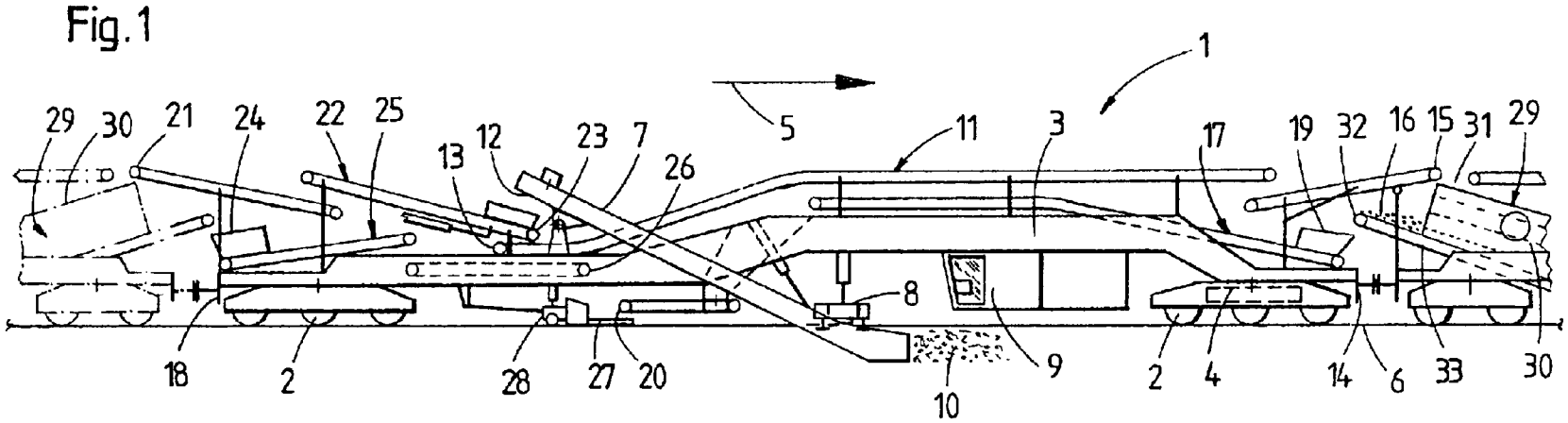
FIG. 1 is a side elevation showing one embodiment of the track rehabilitation machine of this invention.

The drawing shows track rehabilitation machine 1 comprising elongated machine frame 3 supported at its two ends

14, 18 on track 6 by undercarriages 2, 2 for movement in an operating direction indicated by arrow 5. Mounted on the machine frame are vertically adjustable endless ballast excavating chain 7 for excavating dirty ballast 10 whereon the track is supported, first conveyor band unit 11 for conveying the excavated dirty ballast from ballast excavating chain 7 to a ballast transfer station 15 at front machine frame end 14, and a second conveyor band unit 17 for conveying clean ballast from ballast receiving station 19 at the front machine end 14 to a ballast discharge station 20 arranged rearwardly of ballast excavating chain 7.

Drive 4 moves track rehabilitation machine 1 in the operating direction and operator's cab 9 is arranged on machine frame 3 within view of the ballast excavating chain to monitor its operation as well as the that of track lifting device 8 enabling the track to be raised at the ballast excavation point.

First conveyor band unit 11 has a ballast receiving end 13 positioned below discharge end 12 of ballast excavating chain 7 to receive the excavated dirty ballast and convey it to ballast transfer station 15 projecting beyond front end 14 of machine frame 3.

According to this invention, a further ballast transfer station 21 and a further ballast receiving station 24 are arranged at rear machine frame end 18, and a ballast screening car 29 is selectively coupled to one of the machine frame ends, as shown in full lines at the front end and in phantom lines at the rear end. Further conveyor band units 22 and 25 cooperate with the further ballast transfer and receiving stations 21 and 24 for respectively conveying ballast to and from ballast screening car 29 selectively coupled a respective one of the machine frame ends 14, 18. Further conveyor band unit 22 can convey excavated dirty ballast from discharge end 12 of ballast excavating chain 7 to further ballast transfer station 21 for cleaning on screening arrangement 30 of ballast screening car 29, and further conveyor band unit 25 can convey cleaned ballast from further ballast receiving station 24 to ballast discharge station 26 arranged rearwardly of the ballast excavating chain. Both clean ballast discharge stations 20 and 26 are positioned above rail-covering tunnels 27 attached to track lifting device 28 so that the discharged cleaned ballast falls on the track bed and not on the rails.

Ballast screening car 29 may be selectively coupled to the front or rear end of machine frame 3 and carries screening arrangement 30 receiving the dirty ballast on top at an opening 31 and discharging cleaned ballast on the bottom where it is conveyed by conveyor band 33 to discharge end 32.

As shown, each ballast transfer station 15, 21 at each machine frame end 14, 18 is positioned above the ballast receiving station 19, 24. The coupling of ballast screening car 29 to either machine frame end is facilitated if a vertical distance of ballast transfer station 15, 21 and track 6, and of ballast receiving station 19, 24 the track is the same at each machine frame end 14, 18.

Figure 2:
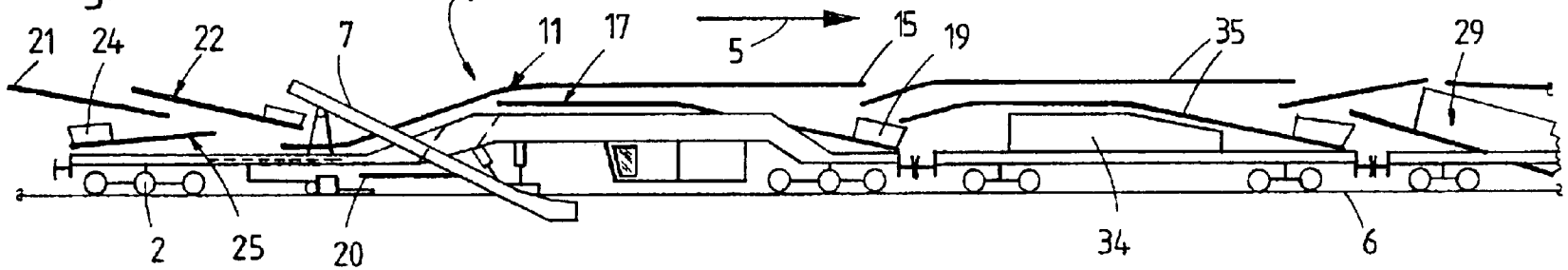
FIG. 2 is a schematized side elevation of a slightly modified embodiment, wherein the same reference numerals designate like parts functioning in a like manner as in the embodiment of FIG. 1.

In the slightly modified embodiment of track rehabilitation machine 1 shown in FIG. 2, energy car 34 is arranged between machine frame 3 and ballast screening car 29, requiring two superposed conveyor bands 35 to extend the length of the first and second conveyor band units 11 and 17, respectively.

Track rehabilitation machine 1 is operated in the following manner:

Dirty ballast 10 is conveyed by first conveyor band unit 11 in the operating direction indicated by arrow 5 to front ballast transfer station 15 whence it is discharged into opening 31 of screening arrangement 30 on ballast screening car 29 coupled to front machine frame end 14. Simultaneously, cleaned ballast coming from the screening arrangement is discharged from discharge end 32 of conveyor band 33 underneath the screening arrangement to front ballast receiving station 19 whence it is conveyed by second conveyor band unit 17 to ballast discharge station 20 whence it is thrown onto the track bed. The detritus produced by cleaning the dirty ballast on screening arrangement 30 is loaded onto cars of a freight train preceding ballast screening car 29. The front cars of the freight train loaded with the detritus are driven to a dump where the detritus is deposited while track rehabilitation machine 1 continues to work.

If working conditions make it advantageous to move the freight train with its storage car for the detritus towards rear end 18 of track rehabilitation machine 1, rather than front end 14, it is only necessary to couple ballast screening car 29 to rear machine frame end 18, The excavated dirty ballast 10 is then conveyed in the opposite direction by actuating further conveyor band unit 22 so that the dirty ballast is conveyed to further ballast discharge station 21 into ballast screening arrangement 30, and further conveyor band unit 25 is actuated to convey the clean ballast to rear ballast receiving station 24 whence it is conveyed to further ballast discharge station 26 for discharge onto the track bed.

What is claimed is:

1. A track bed rehabilitation machine comprising an elongated machine frame supported on the track by undercarriages for movement in an operating direction, the machine frame having two ends, and mounted on the machine frame (a) a vertically adjustable endless ballast excavating chain for excavating dirty ballast whereon the track is supported, (b) a first conveyor band unit for conveying the excavated dirty ballast from the ballast excavating chain to a ballast tranoter station at one machine frame end, (c) a second conveyor band unit for conveying clean ballast from a ballast receiving station at the one machine end to a ballast discharge station arranged rearwardly of the ballast excavating chain and discharging the clean ballast onto the track bed, (d) a further ballast transfer station and a further ballast receiving station at the other machine frame end, and (e) a ballast screening car selectively coupled to a respective one of the machine frame ends, and (f) further conveyor band units cooperating with the further ballast transfer and receiving stations for respectively conveying ballast to and from the ballast screening car selectively coupled to a respective one of the machine frame ends.

2. The track bed rehabilitation machine of claim 1, wherein each ballast transfer station at each machine frame end is positioned above the ballast receiving station.

3. The track bed rehabilitation machine of claim 1, wherein a vertical distance of the ballast transfer station and the track and of the ballast receiving station and the track is the same at each machine frame end.

* * * * *